US008978343B1

(12) United States Patent
Sandor

(10) Patent No.: US 8,978,343 B1
(45) Date of Patent: Mar. 17, 2015

(54) METHOD AND SYSTEM FOR TRANSPORTING A CAST PANEL

(71) Applicant: Frederick J Sandor, Satellite Beach, FL (US)

(72) Inventor: Frederick J Sandor, Satellite Beach, FL (US)

( * ) Notice: Subject to any disclaimer, the term of this patent is extended or adjusted under 35 U.S.C. 154(b) by 0 days.

(21) Appl. No.: 14/334,961

(22) Filed: Jul. 18, 2014

(51) Int. Cl.
*E04B 1/00* (2006.01)
*E04G 21/14* (2006.01)

(52) U.S. Cl.
CPC ..... *E04G 21/147* (2013.01)
USPC ..... 52/745.2; 52/122.1; 52/125.1; 52/126.5; 52/125.4; 52/125.6; 414/10; 414/12

(58) Field of Classification Search
CPC ..... E04G 21/142; E04G 15/04; E04G 21/185; B66C 1/66; B66C 1/666; E04B 1/3511; E04C 2002/002
USPC ..... 52/745.2, 122.1, 125.1, 125.2, 125.3, 52/125.4, 125.5, 125.6, 126.5, 143, 52/749.13, 125; 414/10, 11, 12
See application file for complete search history.

(56) References Cited

U.S. PATENT DOCUMENTS 1,573,263 A * 2/1926 Madden ..... 52/749.13
2,828,618 A * 4/1958 Doescher ..... 52/749.13
3,937,511 A * 2/1976 Inzerill ..... 294/16
4,173,856 A * 11/1979 Fricker ..... 52/125.5
4,303,269 A * 12/1981 Faughnan ..... 294/198
4,714,393 A * 12/1987 Betts ..... 414/10
4,769,960 A * 9/1988 Zipf et al. ..... 52/125.4
5,485,704 A * 1/1996 Sandor, Sr. ..... 52/584.1
5,829,207 A * 11/1998 Mackay Sim et al. ..... 52/125.4
6,694,680 B2 * 2/2004 Zambelli et al. ..... 52/125.2
6,792,734 B2 * 9/2004 Zambelli et al. ..... 52/698
8,407,898 B2 * 4/2013 Marshall ..... 29/897.33
2003/0110715 A1 * 6/2003 Hansort ..... 52/125.6
2005/0257445 A1 * 11/2005 Neef et al. ..... 52/125.2
2006/0117678 A1 * 6/2006 Neighbours ..... 52/125.1
2012/0227335 A1 * 9/2012 Eklund et al. ..... 52/125.4
2012/0304554 A1 * 12/2012 Sladojevic ..... 52/125.4
2013/0097945 A1 * 4/2013 Sladojevic ..... 52/125.4

* cited by examiner

*Primary Examiner* — Robert Canfield
*Assistant Examiner* — Matthew Gitlin
(74) *Attorney, Agent, or Firm* — The Concept Law Group, P.A.; Scott D. Smiley; Mark C. Johnson

(57) ABSTRACT

A method for transporting cast panels is disclosed including providing a cast panel having a body with a first side and a second side, opposite the first side, the body defining a first recess disposed on the first side and defining a second recess disposed on the second side. A first hook-like member is inserted into the first recess to couple the first hook-like member with the body, the first hook-like member operably coupled to a lifting assembly. Thereafter, a second hook-like member is inserted into the second recess to couple the second hook-like member with the body, the second hook-like member operably coupled to the lifting assembly. Finally, the cast panel is transported by applying a lifting force, through the lifting assembly, to the first and second hook-like members.

18 Claims, 11 Drawing Sheets

218

METHOD AND SYSTEM FOR TRANSPORTING A CAST PANEL

FIELD OF THE INVENTION

The present invention relates generally to a method for transporting a cast panel, and, more particularly, relates to a method for transporting a cast panel with a lift device so as to minimize the risk of damage to the cast panel.

BACKGROUND OF THE INVENTION

It is well known that prefabricated or cast-in-place concrete or composite-type panels are often used in building construction to form floors or other horizontal surfaces. Usually, such panels are adjacently placed in abutting, or nearly abutting relationship, on a grid of horizontal steel beams to form the horizontal surfaces. Alternatively, they may be used to create walls or other structures. The voids between adjacent panels are then partially, or wholly, filled with caulking compound or other joining materials.

The panels are often transported using various machines such as cranes, tractors, trucks, or other similar devices. The transportation of such panels can be time consuming and complicated, often resulting in damage to the panels. The manner of transportation often depends on the type, dimension, and weight of the panels. It is beneficial to transport the panels in such a way so as to lift the panels directly with minimal change in position and arrangement.

Some known cast panels are normally prepared for transportation using supports, casings, padding, and other safeguards to prevent damage during transportation. Typical casings and paddings include polythene wrapping, cushion packaging, and timber. This obviously creates more time to prepare each individual panel, which is problematic for many users under construction completion deadlines. Moreover, damage often occurs in the location of the contact areas between the prefabricated elements and the supporting frames during, or associated with, transportation of the panels. When utilizing bolts during the transportation process, it is important to protect any threaded portions of the bolts against rust and thread loss.

With reference to FIG. 1 of the instant application, some known techniques and methods for transporting cast panels are depicted. Transportation of such panels typically occurs in a series of steps. Initially, the panels are produced by casting concrete in a reusable mold or form, which is then cured in a controlled environment. The panels and prefabricated elements are removed from the mold, transported to the desired location, and unloaded for assembly. The panels should be handled with care when removed from the mold as the panels are more susceptible to damage at this stage of transportation.

When transporting the panels, it is important to lift and balance the panels in line with their center of gravity. In order to transports the panels, lifting inserts 104 are often utilized to attach the lines of a lifting assembly, such as a crane, to the panels. The lifting inserts, e.g., 104A, should be placed according to the type of panel. If the lifting inserts are not designed in the appropriate manner, the panel may become bent, the panel may be exposed to unwarranted stress, or the panels may be unintentionally released during the lifting and transportation process. The aforementioned issues may cause destruction of the panels and even unwarranted safety hazards on construction sites. Several factors should be considered when deciding the transportation method, including, but not limited to, the position of the casting mold; the size and weight of the panels; the number, size and location of the lifting inserts; the types of lifting inserts 104; the method of lifting; and the type of lifting equipment.

As seen in FIG. 1, the inserts are required not only to be fastened to the panel in precise locations, but, by the nature of removing material of the body of the panel during the fastening process and after the casting process of the panels, the inserts also decrease the structural integrity of the cast panel. Furthermore, once the cast panel is placed in its desired location, the one or more inserts are then either subjected to the time-intensive task of being removed from the panel or built over with existing material. As mentioned previously, not only is the integrity of cast panels important, due to the load-bearing nature of their applications, but the time to install, prepare, and transport these cast panels is also very important for many users.

Therefore, a need exists to overcome the problems with the prior art as discussed above.

SUMMARY OF THE INVENTION

The present invention provides a method for transporting cast panels, where the method includes providing a cast panel having a body with a first side and a second side, opposite the first side, the body defining a first recess disposed on the first side and defining a second recess disposed on the second side, inserting a first hook-like member into the first recess to couple the first hook-like member with the body, the first hook-like member operably coupled to a lifting assembly, inserting a second hook-like member into the second recess to couple the second hook-like member with the body, the second hook-like member operably coupled to the lifting assembly and transporting the cast panel by applying a lifting force, through the lifting assembly, to the first and second hook-like members. As used herein, the term "providing" is defined in its broadest sense, e.g., bringing/coming into physical existence, make available, or supplying someone or something.

In accordance with a further feature of the present invention, the method includes providing the cast panel with a first inlaid rib member affixed to the first side of the cast panel and a second inlaid rib member affixed to the second side of the cast panel, wherein the first and second inlaid rib members define the first recess and the second recess, respectively.

In accordance with yet another feature of the present invention, the first and second inlaid rib members are of a material different than a material of the cast panel.

In accordance with yet another feature of the present invention, the method includes providing the cast panel with a first inlaid rib member affixed to the first side of the cast panel and a second inlaid rib member affixed to the second side of the cast panel, the first and second inlaid rib members defining a first recess and second recess on the first side, and a third recess and a fourth recess on the second side, and a flange extending upwardly away from the bottom surface and with a portion terminating within the second and fourth recesses, respectively. The method further includes inserting a clip over the flange.

In accordance with yet another feature of the present invention, the first and second inlaid rib members define a U-shaped channel within the body of the cast panel. The U-shaped channel substantially spans an entire length of the first and second sides, respectively, of the cast panel.

In accordance with yet another feature of the present invention, the first and second inlaid rib members include a top surface extending inwardly toward a center of the body of the cast panel, a side surface extending downwardly away from the top surface of the first and second inlaid rib members, and a flange extending downwardly away from the top surface of the first and second inlaid rib members and with a portion terminating within the first and second recesses, respectively. The method further includes inserting the first and second hook-like members into the first and second recesses, respectively, such that a portion of the first and second hook-like members is interposed between the side surface and the flange of the first and second inlaid rib members, respectively.

In accordance with yet another feature of the present invention, the method includes inserting the first and second hook-like members into the first and second recesses, respectively, such that the portion of the first and second hook-like members is abutted with the flange of the first and second inlaid rib members, respectively.

In accordance with yet another feature of the present invention, the method includes providing a second cast panel having a body with a first side and a second side, opposite the first side of the second cast panel, the body of the second cast panel defining a first recess disposed on the first side of the second cast panel and defining a second recess disposed on the second side of the second cast panel. The method further includes inserting at least one of a plurality of hook-like members into the first recess of the second cast panel to couple the at least one of the plurality hook-like members with the body of the second cast panel, the plurality of hook-like members operably coupled to the lifting assembly and including the first hook-like member. The method further includes inserting at least one of a second plurality of hook-like members into the second recess of the second cast panel to couple the at least one of the second plurality of hook-like members with the body of the second cast panel, the second plurality of hook-like members operably coupled to the lifting assembly and including the second hook-like member; and transporting the cast panel and the second cast panel by applying the lifting force, through the lifting assembly, to the plurality and second plurality of hook-like members.

In accordance with an additional feature, the plurality of hook-like members are integrally formed together as one piece of material and the second plurality of hook-like members are integrally formed together as one piece of material.

In accordance with yet another feature of the present invention, the method includes providing the cast panel and the second cast panel with a first inlaid rib member affixed to each of the first side of the cast panel and the first side of the second cast panel and a second inlaid rib member affixed to each of the second side of the cast panel and the second side of the second cast panel, the first and second inlaid rib members defining the first recess and the second recess, respectively, on each of the cast panel and second cast panel.

In accordance with yet another feature of the present invention, the method includes providing the body of the cast panel with a third side and a fourth side, opposite the third side, the body of the cast panel defining a third recess disposed on the third side of the cast panel and defining a fourth recess disposed on the fourth side of the cast panel, wherein the first and second hook-like members are operably configured to be inserted within the third and fourth recesses, respectively, to couple the first and second hook-like members with the body.

In accordance with an additional feature, the first recess, second recess, third recess, and fourth recess are joined together to span a periphery of the body.

In accordance with yet another feature, the first and second recesses form a U-shaped channel within the body of the cast panel, the U-shaped channel openly facing in a direction outwardly away from a center of the body.

In accordance with yet another feature of the present invention, the method includes providing the cast panel with a first inlaid rib member affixed to the first side of the cast panel and a second inlaid rib member affixed to the second side of the cast panel, the first and second inlaid rib members defining the first recess and the second recess, respectively.

In accordance with yet another feature of the present invention, the method includes inserting the first and second hook-like members into the first and second recesses, respectively, without any material removal from the body of the cast panel.

The present invention, according to another embodiment, includes a method for transporting a cast panel, where the method includes providing a cast panel having a body with a first side and a second side, opposite the first side, the body including a first metal inlaid rib member cast into the cast panel and defining a first recess disposed on the first side and including a second metal inlaid rib member cast into the cast panel and defining a second recess disposed on the second side, inserting a first coupling fastener into the first recess to couple the first coupling fastener with the body, the first coupling fastener operably coupled to a lifting assembly, inserting a second coupling fastener into the second recess to couple the second coupling fastener with the body, the second coupling fastener operably coupled to the lifting assembly and transporting the cast panel by applying a lifting force, through the lifting assembly, to the first and second coupling fasteners.

In accordance with a further feature of the present invention, the first and second inlaid rib members include a top surface extending inwardly toward a center of the body of the cast panel, a side surface extending downwardly away from the top surface of the first and second inlaid rib members, and a flange extending downwardly away from the top surface of the first and second inlaid rib members and with a portion terminating within the first and second recesses, respectively. The method further includes inserting the first and second coupling fasteners into the first and second recesses, respectively, such that a portion of the first and second coupling fasteners is interposed between the side surface and the flange of the first and second inlaid rib members, respectively.

In accordance with yet another feature of the present invention, the first and second coupling fasteners include an upright portion coupled to a cable of the lifting assembly and a panel coupling portion extending away from a distal end of the upright portion at at least one of an acute angle and ninety-degree angle to the upright portion.

In accordance with yet another feature of the present invention, the method includes providing the body of the cast panel with a third side and a fourth side, opposite the third side, the body of the cast panel including a third inlaid rib member cast into the cast panel and defining a third recess disposed on the third side of the cast panel and including a fourth inlaid rib member cast into the cast panel and defining a fourth recess disposed on the fourth side of the cast panel, wherein the first and second coupling fasteners are operably configured to be inserted within the third and fourth recesses, respectively, to couple the first and second coupling fasteners with the body.

The present invention, according to another embodiment, includes a system for transporting cast panels, where the system includes a cast panel having a body with a first side and a second side, opposite the first side, the body including a first metal inlaid rib member cast into the cast panel and defining an elongated first recess disposed on the first side and including a second metal inlaid rib member cast into the cast panel and defining an elongated second recess disposed on the second side, a first hook-like member operably coupled to a lifting assembly, the first hook-like member having an upright portion coupled to a cable of the lifting assembly and a panel coupling portion extending away from a distal end of the upright portion at at least one of an acute angle and ninety-degree angle to the upright portion, the panel coupling portion of the first hook-like member sized to be inserted within the first recess and adapted to engage with a portion of the first metal inlaid rib member, and a second hook-like member operably coupled to the lifting assembly, the second hook-like member having an upright portion coupled to the cable of the lifting assembly and a panel coupling portion extending away from a distal end of the upright portion of the second hook-like member at at least one of an acute angle and ninety-degree angle to the upright portion of the second hook-like member, the panel coupling portion of the second hook-like member sized to be inserted within the second recess and adapted to engage with a portion of the second metal inlaid rib member. An elongated recess is generally defined as Although the invention is illustrated and described herein as embodied in a method for transporting a cast panel, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention. Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
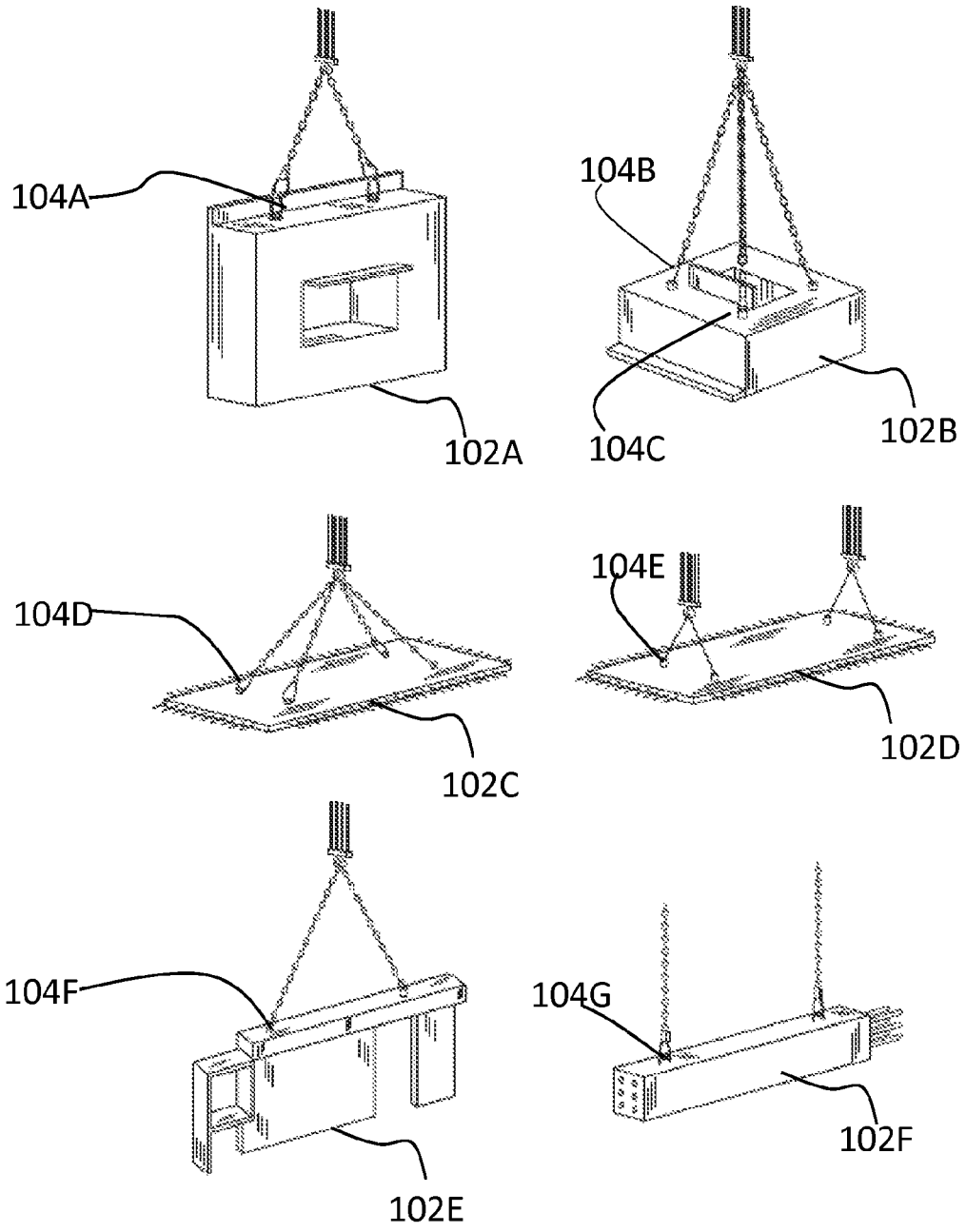
PRIOR ART FIG. 1
FIG. 1 is a perspective view of various methods of lifting a cast panel as shown by the prior art.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient method for transporting a cast panel. Embodiments of the invention provide a method for transporting the cast panel efficiently and effectively without damaging the structural integrity of the panel. In contrast to those known methods that require a fastener or coupling member to be penetrated into the surface of the cast panel, the present invention provides a transportation method that employs the "as-cast" structural configuration and shape of the cast panel to transport the panel without any removal of material or modification after transport. The present invention, therefore, decreases the amount of damage to the cast panel during transportation. In addition, other embodiments of the invention provide a method for simultaneously transporting a plurality of cast panels that increases time and efficiency for transporting multiple cast panels while still decreasing the risk of damage to the cast panels.

Referring now to FIG. 1, various known methods for lifting a cast panel are illustrated. As identified by element 102A, a precast wall is lifted in a vertical position using lifting inserts 104A. Lifting inserts 104A penetrate, i.e., pierce, the body of the cast panel and often cause damage to the structure of the cast panel. As shown by element 102B, the precast wall is lifted in a horizontal position using lifting inserts 104B, 104C. The precise location and design of the lifting inserts 104B, 104C often requires a qualified engineer because the improper design of the lifting inserts 104 may result in damage to the precast walls and an unbalanced panel. Precast slab 102C and 102D can be lifted in a similar manner using multiple lifting points positioned various distances along the precast slab. As shown by elements 102E and 102F, precast beams are lifted using lifting points that are situated a distance from a peripheral the edge of the precast beam. Each of the above prior-art methods disadvantageously require complicated design plans and the task of threading the insert into the cast panel, which destroy the aesthetic appearance and structural integrity of a portion of the cast panel used for the lifting inserts 104A-G.

Figure 2:
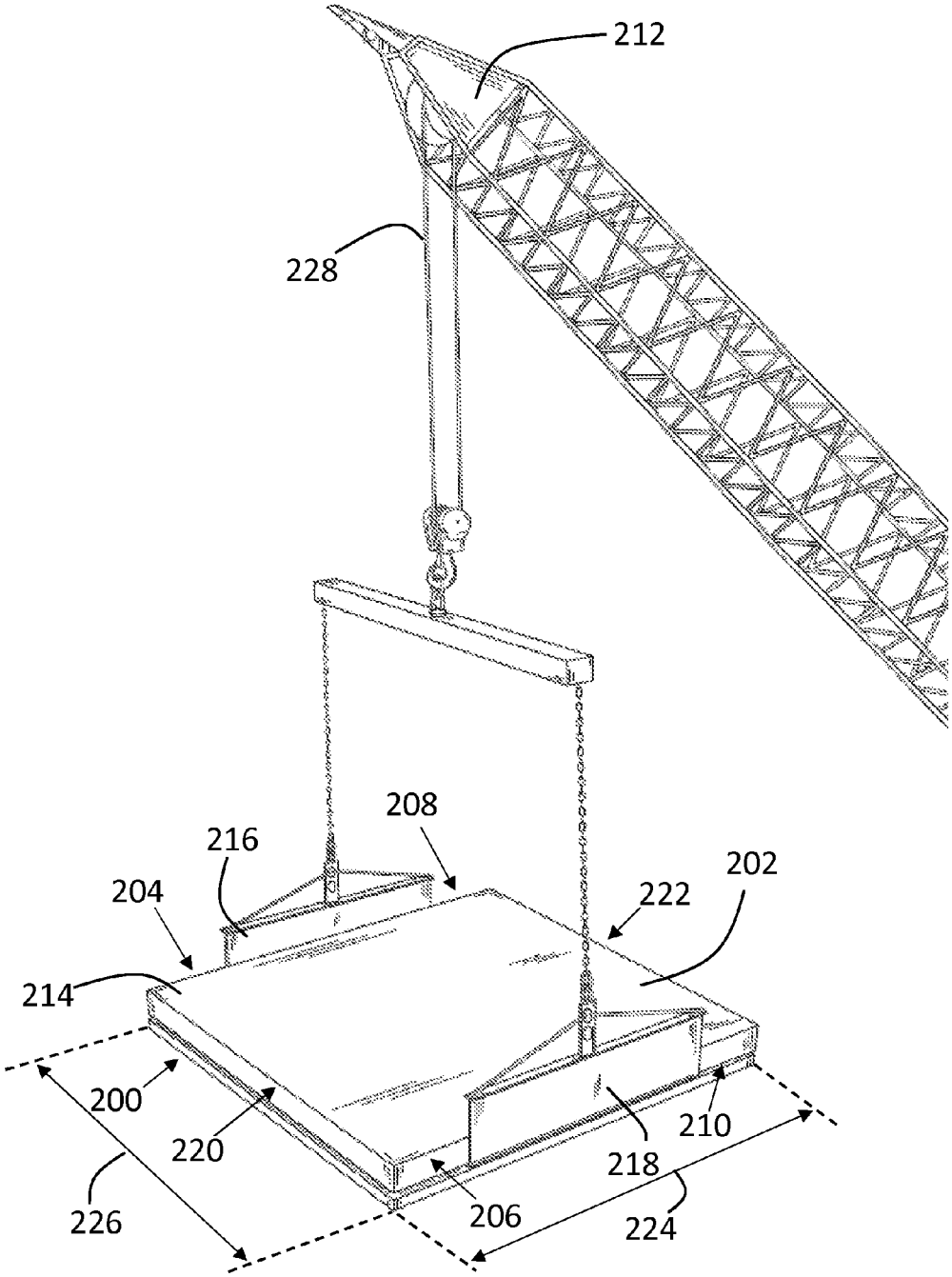
FIG. 2 is a downward perspective view of a method for transporting a cast panel in accordance with an embodiment of the present invention.

Referring now to FIG. 2, one embodiment of the present invention is shown. FIG. 2 shows several advantageous features of the present invention, but, as will be described below, the invention can be provided in several shapes, sizes, combinations of features and components, and varying numbers and functions of the components. In one embodiment, a cast panel 200 is provided with a body 202 having a first side 204 and a second side 206, opposite the first side 204. The body 202 can be seen defining a first recess 208 (better shown in FIG. 3) and a second recess 210. More specifically, first and second recesses 208, 210 are disposed on and defined by the first and second sides 204, 206, respectively. The first side 204 and the second side 206 can be seen as opposing sidewalls, vertically disposed, each sidewall extending a distance between a top surface 214 and an opposing bottom surface 310. Similarly, the body 202 may also have a third side 220 and a fourth side 222, opposite the third side 220. In other embodiments, depending on the shape of the panel 200, the panel 200 may have more or less than four sides. The present invention provides a method of transporting the cast panel 200 using at least two recesses, e.g., 208, 210, formed within the panel via two hook-like members 216, 218 carried by lifting device, e.g., crane 212. Advantageously, the inventive method permits transportation of a cast panel 200 without installing any fasteners that may damage the panel 200 and without removing or modifying the fasteners after placement by the crane 212.

The sides 204, 206, 220, 222 can be seen separating the top wall 214 and the bottom wall 310 (shown in FIG. 3), which may be oriented perpendicular to the sidewalls 204, 206, 220, 222. The cast panel 200 may be a cast concrete panel or other composite-type panel. In one embodiment, the panel 200 may be formed with only two recesses 208, 210 on opposing side walls 204, 206. In an alternative embodiment, as shown in FIG. 2, the first recess 208 and the second recess 210 can be formed as a singular, continuous, recess extending around a peripheral edge of the body 202. In other embodiments, the first and second recesses 208, 210 may be joined together with other recesses on the third and fourth sides 220, 222, respectively, to span a periphery of the body 202 as shown in FIG. 2. In one embodiment, the at least two recesses 208, 210, e.g., grooves sized to receive a distal portion of the hook-like members, span the entire length 224 of the body 202, without interruption so as to facilitate quick and easy coupling with the hook-like members 216, 218. In other embodiments, one or more of the recesses may be discontinuous and may begin and terminate before the terminal ends of the length 224 of the panel 200.

The lifting assembly 212 transports the cast panel 200 by applying a lifting force to the first and second hook-like members 216, 218. The lifting assembly 212 may be a crane, a truck, a sports utility vehicle, or any other machine suitable for transporting the cast panel 200 as would be appreciated by one of ordinary skill in the art. The amount of lifting force applied by the lifting assembly 212 may vary depending on the weight of the cast panel.

Figure 10:
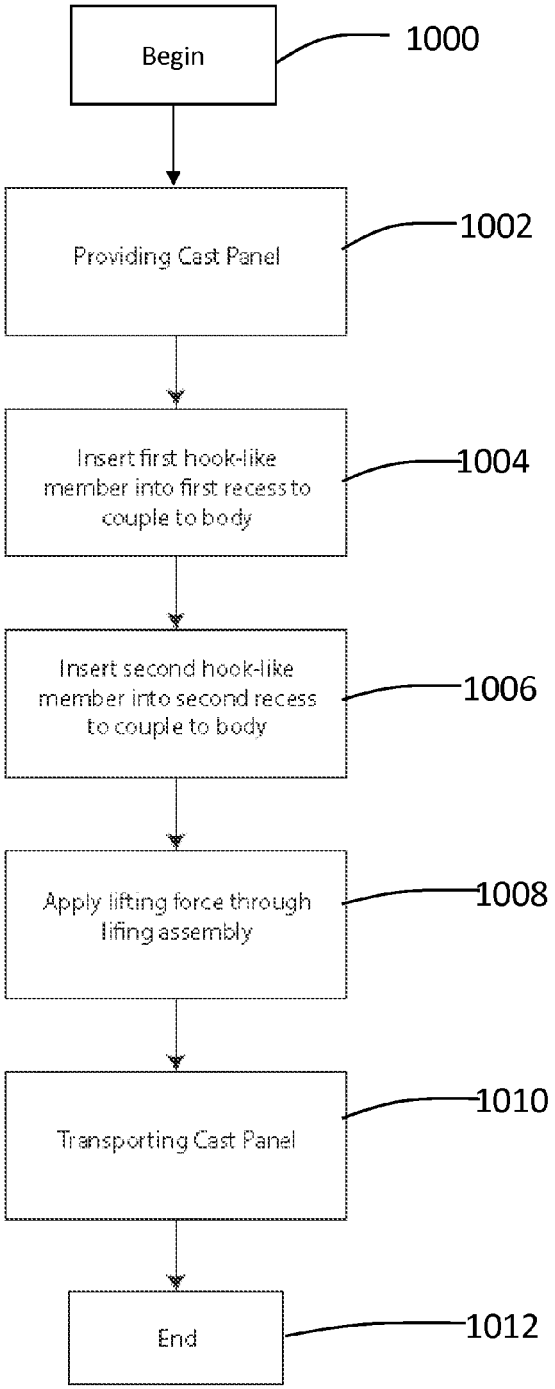
FIG. 10 is a flow diagram for illustrating the method for transporting the cast panel in accordance with FIG. 2.

Now referring to FIG. 3, which depicts an elevational side view of the panel shown in FIG. 2, in conjunction with the process flow diagram shown in FIG. 10, one exemplary embodiment of the present invention will be described. The process of transporting a cast panel begins at step 1000 and immediately proceeds to a step 1002, where a cast panel 200 is provided, e.g., bringing into physical existence. Advantageously, as further described herein, the cast panel 200 will have at least two recesses 208, 210 formed therein. The process continues to steps 1004 and 1006 of inserting the hook-like members 216, 218 into the first and second recesses 208, 210, respectively, to couple the hook-like members 216, 218 to the panel. Next, the process continues to step 1008 where the panel 200 is lifted with a lifting assembly 212 (shown in FIG. 2). Lifting the panel 200 necessarily entails applying a force away from and greater than the weight of the panel 200. Step 1010 naturally flows from step 1008, wherein the panel 200 is then transported to its desired location. In one embodiment, transporting may be only in a vertical direction relative to its resting position. In other embodiments, the panel 200 may be transported both horizontally and vertically. The process then terminates at step 1012. For the present inventive method, the preferred positioning for lifting the cast panel 200 is in the horizontal orientation because such orientation reduces the risk of bending and turning of the cast panel during transport.

Figure 3:
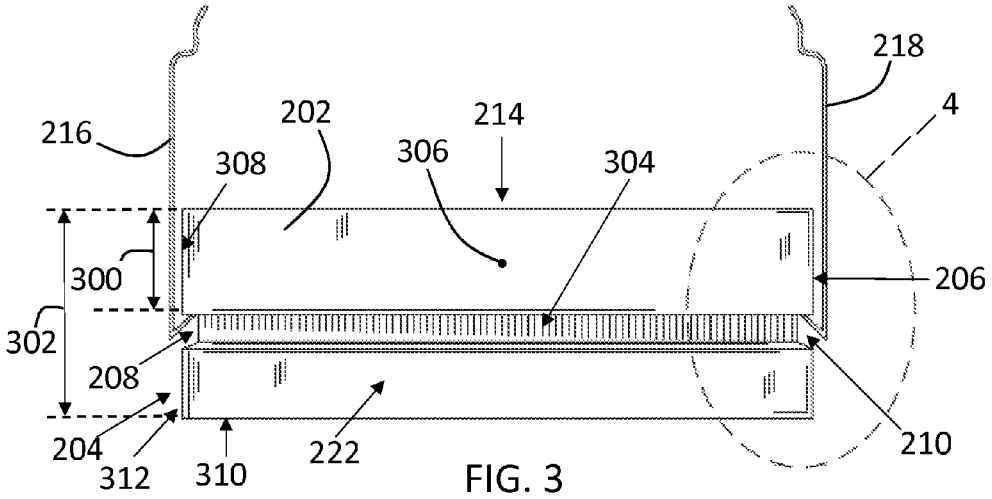
FIG. 3 is an elevational side view of the cast panel of FIG. 2.
Figure 4:
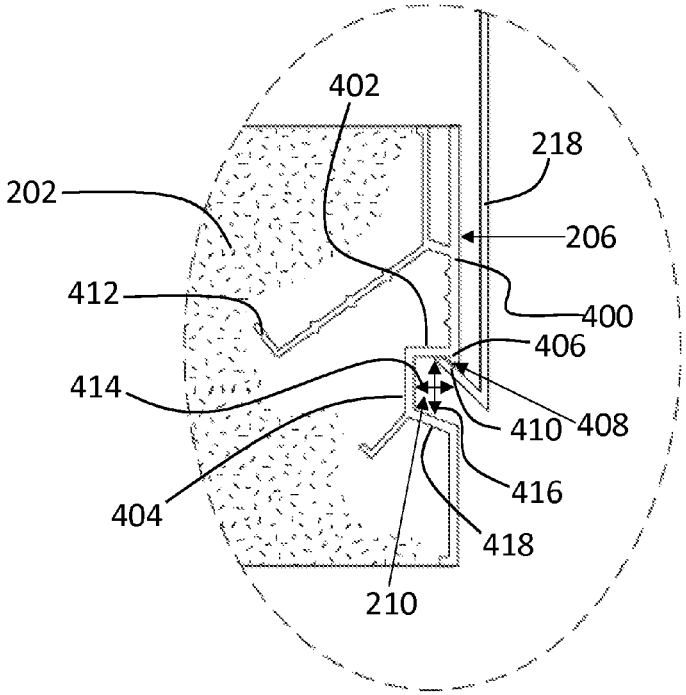
FIG. 4 is a detailed enlarged partial cross-sectional side view of the cast panel and a hook-like member of FIG. 2 (labeled as 4)

With reference now to FIGS. 3 and 4, the hook-like members 216, 218 may be slideably or directly inserted into the first recess 208 and the second recess 210, respectively, without having to permanently affix any fastening members, such as lifting inserts 104, to a visible face of the cast panel 200. Said another way, the hook-like members 216, 218 may be inserted within the recesses 208, 210 of the cast panel 200 without any material removal from the body 202 of the cast panel 200. Advantageously, the hook-like members 216, 218 do not penetrate and cause damage to the face of the cast panel 200 because the outer visible surface of an already formed cast panel 200 is not physically penetrated by the hook-like members 216, 218. An additional advantage provided by the hook-like members 216, 218 being slideably or directly inserted into recesses 208, 210 is that the cast panel 200 can be lifted at a variety of angles, without causing damage to the face of the cast panel 200. Specifically, the hook-like members 216, 218 may be slideably or directly inserted into any one of a number of locations along the recesses 208, 210 to lift the cast panel 200 at a desired angle.

The first recess 208 and the second recess 210 are each a distance 300 away from an upper horizontal surface 214 of the cast panel 200. Although the upper surface 214 and lower surface 310 are depicted as horizontal, those of skill in the art can appreciate that the surfaces 214, 310 may vary with each cast panel transported. The distance 300 is of a sufficient length from the upper horizontal surface 214 of the body 202 such that when the first hook-like member 216 and the second hook-like member 218 are coupled with the body 202, the weight of the body 202 is supported by a significant portion of the cast panel 200. As such, the coupling of the hook-like members 216, 218 to the panel prevents fracture or failure of the cast panel 200 about the portion/flange of the cast panel carrying the weight. Although other distances 300 may be selected based on the geometrical dimensions and/or weight of the panel 200, it is preferred the distance 300 be approximately 50-80% of the overall height 302 of the panel 200. The recesses 208, 210 can also be seen separating their respective sidewalls 204, 206 into an upper portion 308 and a lower portion 312.

While a cast panel 200 may be formed, e.g., cast, with recesses, FIG. 4 depicts a cross-section view of a beneficial embodiment wherein one or more sides have an inlaid rib member 400 extending throughout the length 224 (shown in FIG. 2) of first side 204 and a second inlaid rib member extending throughout the length 224 of the second side 206 of the cast panel 200. While FIG. 4 depicts only the first inlaid rib member, any other rib members discussed herein will be the structural equivalent and applied in the same fashion as the first rib member 400. As used herein, the reference to rib member 400 will also refer to other rib members utilized in conjunction with the cast panel. In this exemplary embodiment, the inlaid rib member 400 defines the first recess 208. A second inlaid rib member will define the second recess 210. In one embodiment, the first and second recesses 208, 210 are formed within the body 202 of the cast panel 200 to distribute the type of internal forces on the cast panel, i.e., compression and shear forces. In alternative embodiments, the first and second recesses 208, 210 not formed within the body, but rather are formed only by the rib members.

The inlaid rib member 400 may be made of a material different than the remainder of the cast panel 200. For example, the cast panel 200 may be comprised of a concrete, stone or other material used in building construction; whereas the inlaid rib member 400 may be made of iron, steel, or any other metal or rigid material of suitable durability for supporting and reinforcing a portion of the cast panel 200 and adapted to engage the hook-like members 216, 218 for transportation. This reinforcement advantageously prevents spalling or cracking of the corners or other surfaces of the cast panel where the hook-like members 216, 218 engage the first and second recess 208, 210, respectively, during transportation of cast panel 200. As depicted in FIG. 4, the inlaid rib member 400 is cast or set within the cast panel so as to form a secure bond or connection with the cast panel. Therefore, the inlaid rib member 400 may be seen having protruding members, e.g., arm 412, that extend within the body 202 of the cast panel 200 to provide resistance to the lifting forces exerted by the lifting assembly 212.

In one embodiment, the inlaid rib member 400 may extend only a portion of the length 224 of the first and second sides 204, 206. Similarly, the recesses 208, 210, whether defined by the inlaid rib member or by the sides 204, 206 of the body 202 without the inlaid rib members, may extend only a portion of the length 224 of the first and second sides 204, 206. Preferably, however, the rib member 400 and the corresponding recesses 208, 210 extend the entire length 224 of the body 202. In embodiments when the body 202 and/or rib member 400 define a third recess 304 and a fourth recess (not shown) on the third and fourth sides 220, 222, respectively, of the panel 200, the third recess 304 and the fourth recess may also extend the entire width 226 (shown in FIG. 2) of the panel 200. The third recess 304 and the fourth recesses advantageously permit the first and second hook-like members 216, 218 to be inserted within each recess, respectively, to couple the first and second hook-like members 216, 218 with the body 202.

The recesses 208, 210, including any other recesses formed on the panel 200, are generally of a depth 414 of approximately 0.5-2 inches and a height 416 of approximately 1-4 inches. In other embodiments, the depth 414 and height 416 may vary outside of the aforementioned ranges based on the specific weight of the cast panel 200 desired to be transported and/or the shape of the hook-like members 216, 218. The depth 414 of the recesses 208, 210 extends generally from a portion forming the side surface 404 to a plane extending downwardly from the flange 406—or to the flange 406 itself. The height 416 of the recesses 208, 210 extends generally from a portion forming the top surface 402 to a portion forming a lower surface 418 of the inlaid rib member 400 and/or cast panel body 202—if the cast panel 200 does not include an inlaid rib member 400. As shown in FIG. 4, the lower surface 418—when preferably formed on the cast panel 200, may be generally at an obtuse angle to the side surface 404 to beneficially facilitate the insertion and removal of a hook-like member 218 or, in alternative embodiments, may be at a right and/or acute angle.

In preferred embodiments, the inlaid rib member 400 may define a U-shaped channel within the body 202 of the cast panel 200 that substantially spans, i.e., 80-90%, the entire length 224 of the first and second sides 204, 206, respectively, of the cast panel 200. The term "U-shaped" is defined as having at least three sides with two vertices or two sides and one vertices where the two sides intersect. The U-shaped channel formed by the shape of the recesses 208, 210 can be advantageously seen openly facing in a direction outwardly away from the center 306 of the body 202 to facilitate in the insertion and removal of the hooks 216, 218.

In one embodiment, the inlaid rib member 400 includes a top surface 402 extending inwardly toward a center, e.g., point 306 in FIG. 3, of the body 202 of the cast panel 200, a side surface 404 extending downwardly away from the top surface 402, and a flange 406 extending downwardly away from the top surface 402. The flange 406 can be seen with a distal portion 408 terminating within the first recess 208. Advantageously, the hook-like members 216, 218 may be inserted within the first and second recesses 208, 210, respectively, and placed therein such that a portion, e.g., 410, of the first and second hook-like members 216, 218 is interposed between the side surface 404 and the flange 406 of the respective inlaid rib member to inhibit removal of the hook-like members 216, 218 during transport of the panel 200.

Alternatively, in some embodiments, when the hook-like members 216, 218 are inserted within the recesses 208, 210, the portion 410 of the first and second hook-like members 216, 218 is abutted with the flange 406 of the respective inlaid rib members. As a result, the hook-like members 216, 218 are advantageously secured to the cast panel 200 during transport. In some embodiments, the inlaid rib member 400 has a portion projecting outwardly into the channel to prevent horizontal movement of the hook-like members 216, 218 when inserted therein. Preferably the portion projecting outwardly into the channel would be located proximal to the distal ends of the length 224 of the sides 204, 206. Beneficially, the hook portion 410 of the hook-like members 216, 218 is inserted under the flange 406 and, when the lifting force is applied by the lifting assembly 212, the cast panel 200 hangs from the first and second hook-like members 216, 218 and is frictionally and mechanically retained within the first and the second recess 208, 210, respectively, by the inlaid member 400 and its flange 406.

Figure 5:
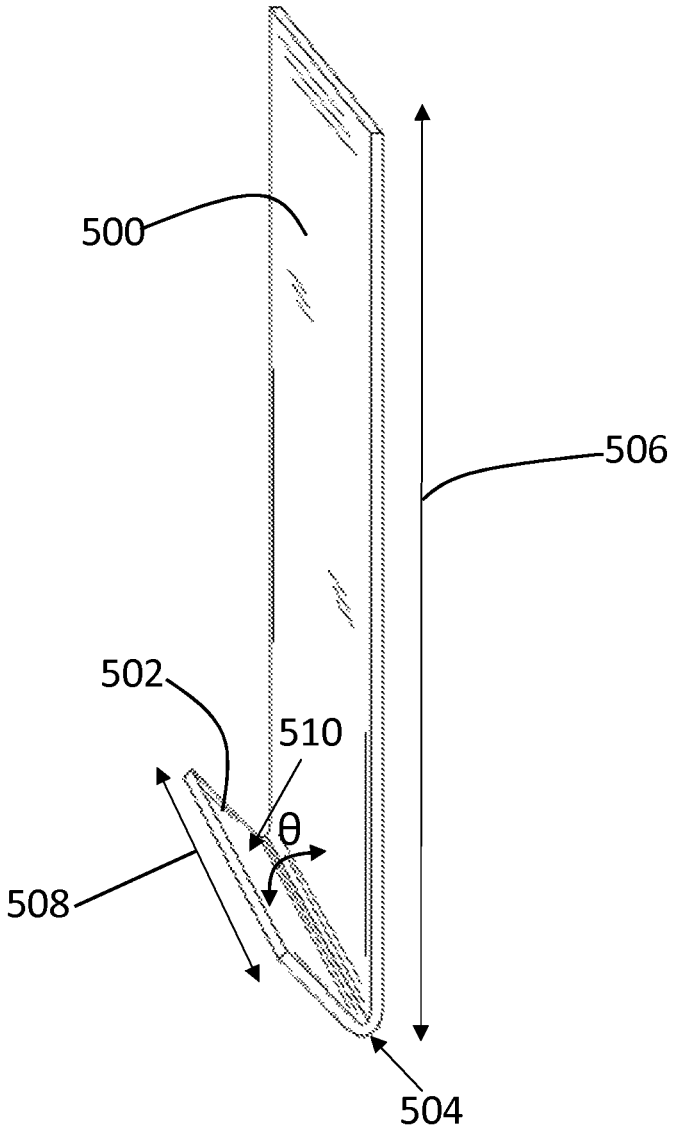
FIG. 5 is an enlarged, perspective view of the hook-like member of FIG. 2.

Referring now to FIG. 5, the hook-like member 218 is illustrated in an enlarged view. While FIG. 5 depicts the first hook-like member 218, any other hook-like member or coupling fastener discussed herein may be the structural equivalent and applied in the same fashion as the first hook-like member 400. The hook-like members 216, 218 may be a hook, latch, crow bar, or other hook-like structure. The term "hook-like member" is defined herein as a piece of material having at least one upright structure or portion and an arm extending from that upright structure that is curved or bent back at an angle θ that is either acute or 90 degrees. As such, the hook-like member 218 can be seen having an upright portion 500 that is coupled to a cable 230 of the lifting assembly 212 and a panel coupling portion 502 extending away from a distal end 504 of the upright portion 500. The panel coupling portion 502 can be seen extending away from the upright portion 500 at about a 45 degree angle θ. The panel coupling portion 502 preferably has a substantially planar surface 510 that extends laterally in a substantially parallel (i.e., within +/−10° deviation of parallel) direction of the recess, e.g., recess 210. Moreover, the width 508 of the coupling portions of the first and second hook-like members 216, 218 are also at least twenty-five percent an overall length 224 (or width 226 depending on the embodiment) of the first and second recesses 208, 210. Preferably, however, the width 508 of the coupling portions of the first and second hook-like members 216, 218 are also at least fifty percent the overall length 224 of the first and second recesses 208, 210. The above structure of the hook-like members beneficially provides users the ability to safely and effectively transport cast panels with low risk of structural failure of the components.

The length 506 of the upright portion 500 of the hook-like members 216, 218 may be approximately two to four feet. In other embodiments, the length 506 may vary outside of that range. The upright portion 500 is generally planar, but may be, in certain embodiments, have one or more curved sections within. A width 508 of the hook-like members 216, 218 may be approximately six to twelve inches. In other embodiments, the width 508 may vary outside of that range. In an embodiment, the hook-like members 216, 218 are of made of steel material. In another embodiment, the hook-like members 216, 218 are made of only iron, metal-composite material, or any other type of metal or rigid material of similar durability to sustain the weight of a cast panel 200 during transportation. The hook-like members 216, 218 are removably connected to the lifting assembly 212. In one embodiment, the hook-like members 216, 218 connect to the lifting assembly 212 by a cable 228. In another embodiment, the hook-like members 216, 218 may connect to the lifting assembly 212 by a rope, a pulley system, or another suitable cord as would be appreciated by one of ordinary skill in the art.

Figure 6:
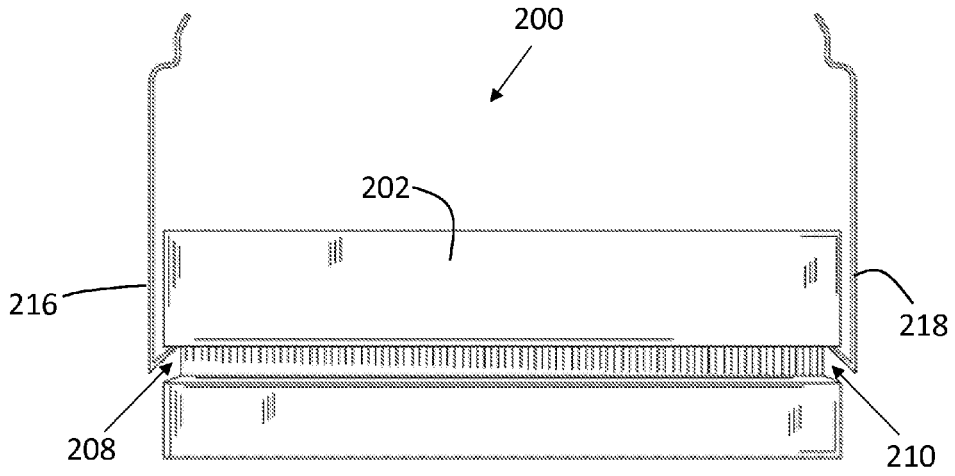
FIG. 6 is an elevational side view illustrating the method of FIG. 2 showing the cast panel lifted from a horizontal position.

FIG. 6 illustrates an elevational side view of the cast panel 200 lifted from a horizontal starting position. The cast panel 200 is lifted in the horizontal position from a starting point and transported to a predetermined end point. The horizontal position is the preferred position for lifting utilizing the present method because the hook-like members 216, 218 can be slideably or directly inserted from the sides 204, 206 into the first recess 208 and the second recess 210 to couple with the body 202 of the cast panel 200. In such a configuration, a weight of the cast panel 200 is evenly distributed, thereby preventing the cast panel 200 from movement and bending during transportation. Moreover, it reduces the time-intensive task of properly placing hooks or other fasteners 104A into the body 202 of the panel as shown in FIG. 1.

Figure 7:
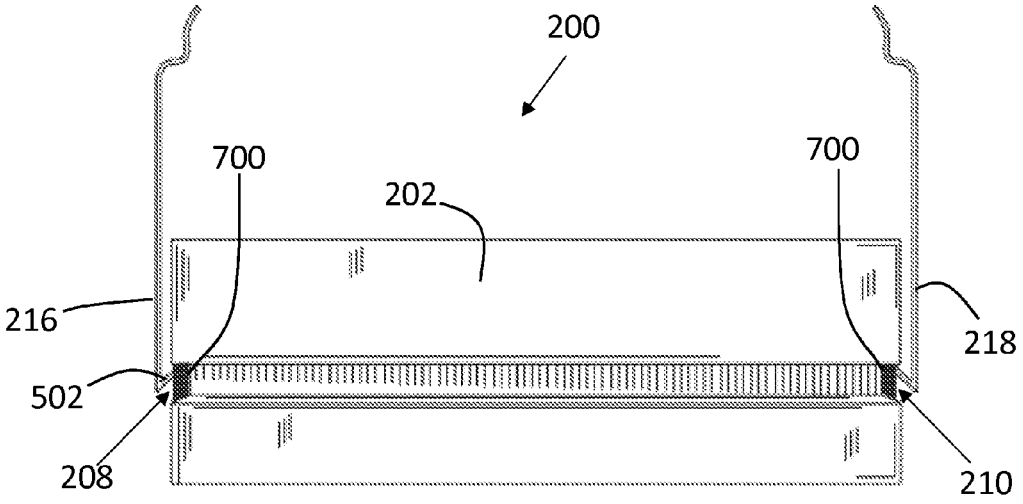
FIG. 7 is an elevational side view illustrating hook-like members used to transport a cast panel in accordance with an embodiment of the present invention.

Moreover, with reference to FIG. 7, in an additional embodiment of the present invention the panel coupling portion 502 of the hook-like members 216, 218 may have a portion 700 shaped and sized to substantially fill the recess to which it is inserted. Said another way, the panel coupling portion 502 will have a complimentary portion 700 that is shaped and sized to mate with and substantially fill the void, i.e., 80-100%, of the recess to which it is inserted. This advantageously creates an attachment that substantially resists movement of the hook-like members 216, 218 along the width 218 of the panel 200. To insert the hook-like members 216, 218 within the respective recesses 208, 210 the user either slides the complimentary portion 700 within the recesses 208, 210 or inserts a top portion of the complimentary portion 700 under the flange 406 by angling the same under the flange 406. The user would then insert a bottom portion of the complimentary portion 700 into the respective recess 208, 210.

Figure 8:
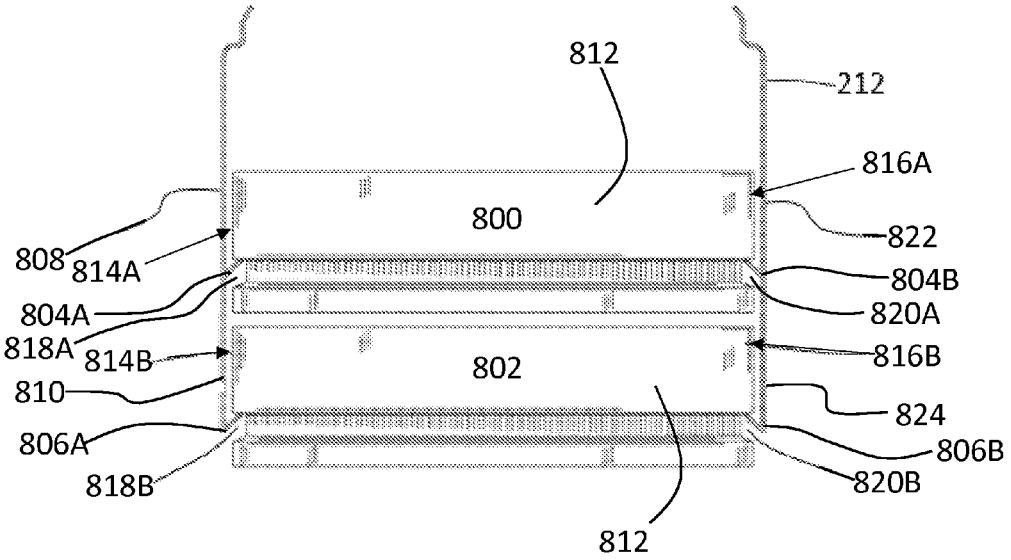
FIG. 8 is an elevational side view illustrating an alternative embodiment of a method for transporting a cast panel, in accordance with the present invention.

FIG. 8 shows an additional embodiment of the method for transporting a plurality of cast panels 800, 802. In this embodiment, a plurality of cast panels 800, 802 may be transported simultaneously. Said another way, a second cast panel 802 is provided with similar dimensions as the first cast panel 800. The cast panels 800, 802 may be formed and shaped as discussed herein with regard to cast panel 200. The second cast panel 802 may be positioned a distance from the cast panel 802. This distance is dictated by a distance separating a portion of the panel coupling portions 804A, 806A on a first plurality of hook-like members 808, 810. Naturally, this distance is also dictated by a distance separating the panel coupling portions 804B, 806B on a second plurality of hook-like members 822, 824. The first and second cast panels 800, 802 are of a configuration similar to that of the cast panel 200. For example, the cast panels 800, 802 each include a body 812 with first sides 814A, 814B and second sides 816A, 816B opposite the first side 814A, 814B, respectively. The body 812 defines a first recess 818A, 818B disposed on the first side 814A, 814B and a second recess 820A, 820B disposed on the second side 816A, 816B of each of the cast panels 800, 802.

The first plurality of hook-like members 808, 810 are inserted into the recesses 818A, 818B to couple with the body 812. More specifically, the panel coupling portions 804A, 806A of the first plurality of hook-like members 808, 810 are inserted into the first recess 818A of the first and second cast panels 800, 802 to couple the plurality of hook-like members 808, 810 with the bodies 812 of the first and second cast panels 800, 802. The first plurality of hook-like members 808, 810 are operably coupled to the lifting assembly 212 and would include a hook-like member similar to the first hook-like member 216 described above. Said another way, the present invention may utilize the hook-like member 216 as part of the first plurality of hook-like members 808, 810. Similarly, the second plurality of hook-like members 822, 824 are operably coupled to the lifting assembly and may include the second hook-like member 218. A second plurality of hook-like members 822, 824 is inserted in a similar fashion as the first plurality of hook-like members 808, 810. After insertion, the cast panels 800, 802 are transported by applying the lifting force, through the lifting assembly 212, to first and second plurality of hook-like members 808, 810, 822, 824.

In one embodiment, as shown in FIG. 8, the plurality of hook-like members 808, 810 are integrally formed together as one piece of material and the second plurality of hook-like members 822, 824 are integrally formed together as one piece of material. Further, in one embodiment, the cast panels 800, 802 are integral with one another. The embodiment shown in FIG. 8 advantageously permits multiple cast panels 800, 802 to be transported with ease and more efficiency.

Figure 9:
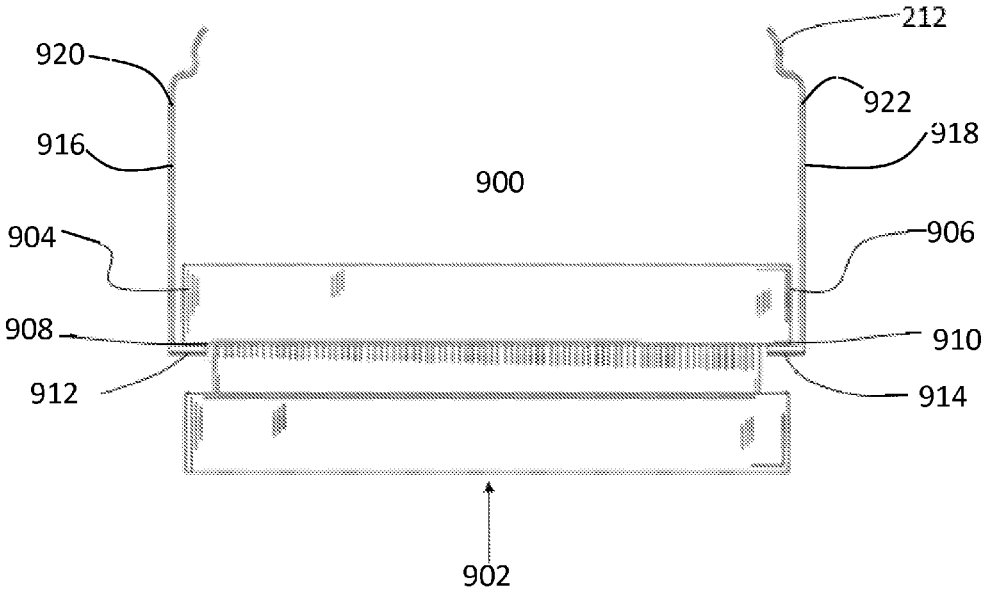
FIG. 9 is an elevational side view illustrating an alternative embodiment of a method for transporting a cast panel, in accordance with the present invention.

FIG. 9 illustrates a variation of the method for transporting a cast panel 900 in accordance with the present invention. The method includes providing the cast panel 900 having a body 902 with a first side 904 and a second side 906, opposite the first side 904. The body 902 defines a first step 908 on the first side 904 and a second step 910 on the second side 906. In one embodiment, the first step 908 and the second step 910 may be of a material different than the remainder of the cast panel 900 so as to reinforce the body 902 of cast panel 900 at the location of the first step 908 and second step 910. The cast panel 900 may be comprised of a concrete or stone material. In another embodiment, the first step 908 and the second step 910 may be made of iron. In another embodiment, the first step 908 and the second step 910 may be made of steel, metal or any other similar material.

A panel coupling portion 912 of a first coupling fastener 920 is inserted under a bottom side of the first step 908 to couple with the body 902. The panel coupling portion 912 is operably coupled to the lifting assembly 212 via an upright portion 916 of the first coupling fastener 920. Thereafter, a panel coupling portion 914 of a second coupling fastener 922 is inserted under a bottom side of the second step 910 to couple with and support the body 902. The second coupling fastener 922 is operably coupled to the lifting assembly 212 via an upright portion 918 of the second coupling fastener 922.

The coupling fasteners 920, 922 may be inserted under the bottom side of the first step 908 and the bottom side of the second step 910, respectively. In one embodiment, each of the panel coupling portions 912, 914 are at a right angle with respect to the upright portions 916, 918 of their respective coupling fastener 920, 922. Said another way, the panel coupling portions 912, 914 together with their respective upright portions 916, 918, form an L-shape. The upright portions 916, 918 of the coupling fasteners 920, 922 are removably connected to the lifting assembly 212 by a cable. The cast panel 900 may be transported by applying a lifting force, through the lifting assembly 212, to the first and second coupling fasteners 920, 922.

Figure 11:
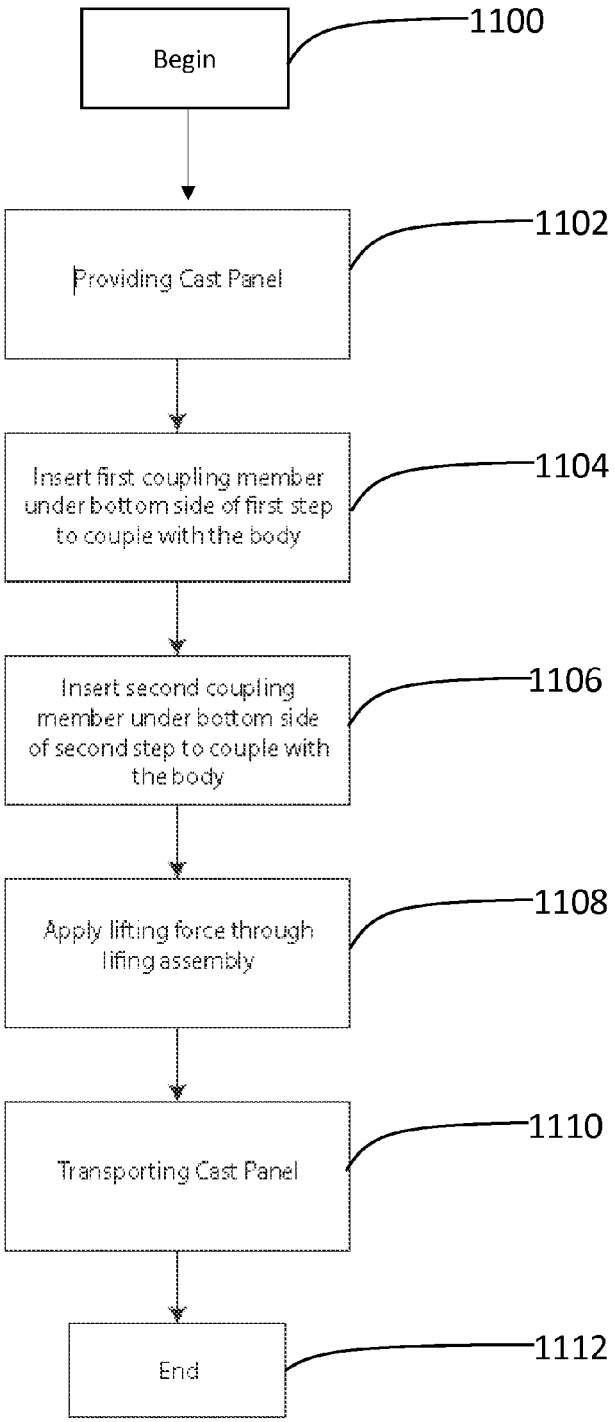
FIG. 11 is a flow diagram for illustrating an alternative embodiment of the method for transporting the cast panel in accordance with FIG. 8.

With reference to FIG. 11, a flow diagram for illustrating an alternative embodiment of the method for transporting the cast panel in accordance with the present invention is shown. The method of FIG. 11 begins at step 1100 and moves directly to step 1102, providing a cast panel 900 as illustrated in FIG. 9. The cast panel has a body with a first side and a second side, opposite the first side. The body defines a first step disposed on the first side and defining a second step disposed on the second side. In step 1104, a first coupling fastener is inserted under the bottom side of the first step to couple with the body. In step 1106, the second coupling fastener is inserted under the bottom side of the second step to couple with the body. In step 1108, a lifting force is applied to the first and second coupling fasteners through the lifting assembly. In step 1110, the cast panel is transported. The process ends at step 1110.

Figure 12:
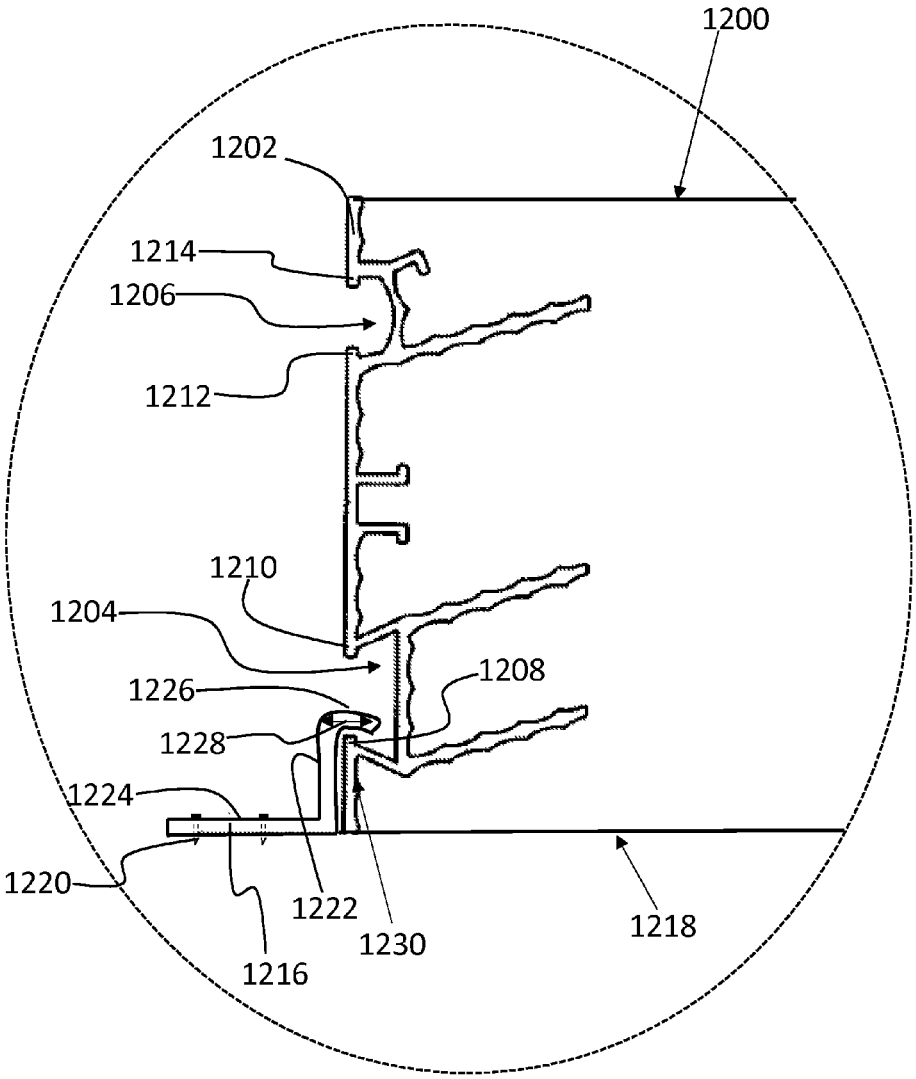
FIG. 12 is a detailed enlarged partial cross-sectional view of a panel and a clip, in accordance with the present invention.

In an additional embodiment of the present invention, as illustrated in FIG. 12, a panel 1200 includes an inlaid rib member 1202 affixed thereto with a clip 1216 adapted to engage with a portion of the inlaid rib member 1202. The clip 1216 provides a user with the advantageous ability to retain the cast panel 1200 to a building structure 1218 after it has been transported to its desired location. The inlaid rib member 1202 can be seen defining a plurality of channels 1204, 1206. In other embodiments, the inlaid rib member 1202 will have a structure similar to that shown in FIG. 4. The inlaid rib member 1202 can also be seen having flanges 1208, 1210, 1212, 1214 similar in structure to those above-described flange(s), e.g., flange 406. The inlaid rib member 1202 is shown in a cross-sectional view, but it may span along the entire, or a portion of, the length 224 or width 226 of the panel 1200 as described above. As shown in FIG. 12, the flange 1208 is shaped to receive the clip 1216. In the embodiments described above, for example, the clip 1216 would engage with the panel 1200 via a lower portion 1230 of the inlaid rib member 1202.

To transport the panel 1200, the hook-like member 216, as described above, will be inserted into the first recess/channel 1204 or the second recess/channel 1206, while another hook-like member will be inserted into one or more recesses disposed on, and defined by, the other side of the cast panel 1200.

In one embodiment, the clip 1216 is a piece of material with an upright portion 1222, a second portion 1224 substantially perpendicular to the upright portion 1222, and an arm 1226 extending from the upright portion 1222 that may be curved or bent back at an angle θ that is either acute or 90 degrees. The arm 1226 of the clip 1216 is sized and shaped to be inserted within one or more recesses prevent the cast panel 1200 from experiencing any movement in the vertical direction from which it is installed onto the building structure 1218. As those of skill in the art can appreciate, the size and shape of the arm 1226 of the clip 1216 may vary based on size and shape of the recess 1204 to which it is inserted. For example, with brief reference to FIG. 4, if the height 416 of the channel was 4 inches and the depth 414 of the channel was 4 inches, the arm 1226 would have a length 1228 less than proximately 4 inches and a thickness no greater than approximately 4 inches. "Substantially perpendicular" is defined herein as forming a right angle, or approximately a right angle with another line, plane or surface. In another embodiment, the clip 1216 may be latch, hook, or another similar shape and/or component used to secure the cast panel 1200 to the building structure 1218. The length of the clip 1216 may vary depending on the size and shape of the cast panel 1200 and its channels, e.g., recess 1204. The positioning of the clip 1216, with respect to the flange 1208, may also vary with depending on the size of the cast panel 1200 and the structure. In an embodiment, the clip 1216 may be made of steel material. In another embodiment, the clip 1216 is made of only iron, metal-composite material, or any other type of metal or rigid material of similar durability.

The clip 1216 is shown inserted over the flange 1208 to secure the panel 1200 to the building structure 1218. The term "structure" is defined herein as one or more pieces used in a framework or support structure disposed within a building, house, dwelling, shelter, or other similar building. For example, in use, the cast panel 1200 may be lifted by the lifting assembly and placed on the structure 1218, wherein the clip 1216 may be inserted over the flange 1208 and secured to a building structure 1218 by one or more fasteners 1220.

What is claimed is:

1. A method for transporting cast panels, the method comprising:

providing a cast panel having a body with a first side and a second side, the second side opposite the first side, the body defining a first recess disposed on the first side and defining an opposing second recess disposed on the second side;

inserting a width of a coupling portion of a first hook-like member into the first recess to couple the first hook-like member with the body, the first hook-like member having an upright portion operably coupled to a lifting assembly and the width of the coupling portion of the first hook-like member is at least twenty-five percent an overall length of the first recess, the coupling portion extending away from a distal end of the upright portion at an acute angle to the upright portion;

inserting a width of a coupling portion of a second hook-like member into the second recess to couple the second hook-like member with the body, the second hook-like member having an upright portion operably coupled to the lifting assembly and the width of the coupling portion of the second hook-like member is at least twenty-five percent an overall length of the second recess, the coupling portion extending away from a distal end of the upright portion at an acute angle to the upright portion; and transporting the cast panel by applying a lifting force, through the lifting assembly, to the first and second hook-like members.

2. The method according to claim 1, further comprising:

providing the cast panel with a first inlaid rib member affixed to the first side of the cast panel and a second inlaid rib member affixed to the second side of the cast panel, the first and second inlaid rib members defining the first recess and the second recess, respectively.

3. The method according to claim 2, wherein:

the first and second inlaid rib members are of a material different than a material of the cast panel.

4. The method according to claim 2, further comprising:

placing the cast panel onto a building structure; and retaining the cast panel to the building structure with a clip, the clip fastened to the building structure and having a portion sized and shaped to be inserted within the first and second recesses.

5. The method according to claim 2, wherein:

the first and second inlaid rib members define a U-shaped channel within the body of the cast panel, the U-shaped channel substantially spanning an entire length of the first and second sides, respectively, of the cast panel.

6. The method according to claim 2, wherein the first and second inlaid rib members include a top surface extending inwardly toward a center of the body of the cast panel, a side surface extending downwardly away from the top surface of the first and second inlaid rib members, and the flange extending downwardly away from the top surface of the first and second inlaid rib members and with a portion terminating within the first and second recesses, respectively, further comprising:

inserting the first and second hook-like members into the first and second recesses, respectively, such that a portion of the first and second hook-like members is interposed between the side surface and the flange of the first and second inlaid rib members, respectively.

7. The method according to claim 6, further comprising:

inserting the first and second hook-like members into the first and second recesses, respectively, such that the portion of the first and second hook-like members is abutted with the flange of the first and second inlaid rib members, respectively.

8. The method according to claim 1, further comprising:

providing a second cast panel having a body with a first side and a second side, opposite the first side of the second cast panel, the body of the second cast panel defining a first recess disposed on the first side of the second cast panel and defining a second recess disposed on the second side of the second cast panel;

inserting at least one of a plurality of hook-like members into the first recess of the second cast panel to couple the at least one of the plurality of hook-like members with the body of the second cast panel, the plurality of hook-like members operably coupled to the lifting assembly and including the first hook-like member;

inserting at least one of a second plurality of hook-like members into the second recess of the second cast panel to couple the at least one of the second plurality of hook-like members with the body of the second cast panel, the second plurality of hook-like members operably coupled to the lifting assembly and including the second hook-like member; and transporting the cast panel and the second cast panel by applying the lifting force, through the lifting assembly, to the plurality and second plurality of hook-like members.

9. The method according to claim 8, wherein:

the plurality of hook-like members are integrally formed together as one piece of material and the second plurality of hook-like members are integrally formed together as one piece of material.

10. The method according to claim 9, further comprising:

providing the cast panel and the second cast panel with a first inlaid rib member affixed to each of the first side of the cast panel and the first side of the second cast panel and a second inlaid rib member affixed to each of the second side of the cast panel and the second side of the second cast panel, the first and second inlaid rib members defining the first recess and the second recess, respectively, on each of the cast panel and second cast panel.

11. The method according to claim 1, further comprising:

providing the body of the cast panel with a third side and a fourth side, opposite the third side, the body of the cast panel defining the third recess disposed on the third side of the cast panel and defining the fourth recess disposed on the fourth side of the cast panel, wherein the first and second hook-like members are operably configured to be inserted within the third and fourth recesses, respectively, to couple the first and second hook-like members with the body.

12. The method according to claim 11, wherein:

the first recess, second recess, third recess, and fourth recess are joined together to span a periphery of the body.

13. The method according to claim 1, wherein:

the first and second recesses form a U-shaped channel within the body of the cast panel, the U-shaped channel openly facing in a direction outwardly away from a center of the body.

14. The method according to claim 13, further comprising:

providing the cast panel with a first inlaid rib member affixed to the first side of the cast panel and a second inlaid rib member affixed to the second side of the cast panel, the first and second inlaid rib members defining the first recess and the second recess, respectively.

15. The method according to claim 1, further comprising:

inserting the first and second hook-like members into the first and second recesses, respectively, without any material removal from the body of the cast panel.

16. A method for transporting cast panels, the method comprising:

providing a cast panel having a body with a first side and a second side, opposite the first side, the body including a first metal inlaid rib member cast into the cast panel and defining a first recess disposed on the first side and including a second metal inlaid rib member cast into the cast panel and defining a second recess disposed on the second side, the first and second inlaid rib members including a top surface extending inwardly toward a center of the body of the cast panel, a side surface extending downwardly away from the top surface of the first and second inlaid rib members, and a flange extending downwardly away from the top surface of the first and second inlaid rib members and with a portion terminating within the first and second recesses, respectively;

inserting a first coupling fastener and a second coupling fastener into the first and second recesses, respectively, such that a distal portion of the first and second coupling fasteners abuts the top surface and is interposed between the side surface and the flange of the first and second inlaid rib members, respectively, the first coupling fastener and the second coupling fastener operably coupled to a lifting assembly; and transporting the cast panel by applying a lifting force, through the lifting assembly, to the first and second coupling fasteners.

17. The method according to claim 16, further comprising:

providing the body of the cast panel with a third side and a fourth side, opposite the third side, the body of the cast panel including a third inlaid rib member cast into the cast panel and defining a third recess disposed on the third side of the cast panel and including a fourth inlaid rib member cast into the cast panel and defining a fourth recess disposed on the fourth side of the cast panel, wherein the first and second coupling fasteners are operably configured to be inserted within the third and fourth recesses at any point along the third and fourth recesses, respectively, to couple the first and second coupling fasteners with the body.

18. A system for transporting cast panels, comprising:

a cast panel having a body with a first side and a second side, opposite the first side, the body including a first metal inlaid rib member cast into the cast panel and defining an elongated first recess disposed on the first side and including a second metal inlaid rib member cast into the cast panel and defining an elongated second recess disposed on the second side, the first and second inlaid rib members including a top surface extending inwardly toward a center of the body of the cast panel, a side surface extending downwardly away from the top surface of the first and second inlaid rib members, and a flange extending downwardly away from the top surface of the first and second inlaid rib members and with a portion terminating within the first and second recesses, respectively;

a first hook-like member operably coupled to a lifting assembly, the first hook-like member having an upright portion coupled to a cable of the lifting assembly and a panel coupling portion extending away from a distal end of the upright portion in an acute angle to the upright portion, the panel coupling portion of the first hook-like member sized to be inserted within the first recess such that a distal portion of the first hook-like member abuts the top surface and is interposed between the side surface and the flange of the first metal inlaid rib member; and a second hook-like member operably coupled to the lifting assembly, the second hook-like member having an upright portion coupled to the cable of the lifting assembly and a panel coupling portion extending away from a distal end of the upright portion of the second hook-like member in an acute angle to the upright portion of the second hook-like member, the panel coupling portion of the second hook-like member sized to be inserted within the second recess such that a distal portion of the first hook-like member abuts the top surface and is interposed between the side surface and the flange of the second metal inlaid rib member.

* * * * *